US005835866A

United States Patent [19]

Bridges et al.

[11] Patent Number: 5,835,866

[45] Date of Patent: Nov. 10, 1998

[54] METHOD FOR TREATING RADIOACTIVE WASTE

[75] Inventors: Jack E. Bridges, Park Ridge; Guggilam C. Sresty, Burbank, both of Ill.

[73] Assignee: IIT Research Institute, Chicago, Ill.

[21] Appl. No.: 588,906

[22] Filed: Jan. 19, 1996

Related U.S. Application Data

[63] Continuation of Ser. No. 454,009, May 30, 1995, abandoned, which is a continuation of Ser. No. 96,361, Jul. 22, 1993, abandoned, which is a continuation of Ser. No. 952,205, Sep. 28, 1992, abandoned, which is a continuation of Ser. No. 502,288, Mar. 30, 1990, abandoned.

[51] Int. Cl.[6] ..... G21F 9/00

[52] U.S. Cl. ..... 588/19; 166/248

[58] Field of Search ..... 588/19; 166/248

[56] References Cited

U.S. PATENT DOCUMENTS

| | | | |
|---|---|---|---|
| Re. 30,738 | 9/1981 | Bridges et al. | 166/248 |
| 2,459,622 | 1/1949 | Cohoe et al. | 219/10.41 |
| 2,542,028 | 2/1951 | Hodge | 202/113 |
| 4,140,180 | 2/1979 | Bridges et al. | 166/248 |
| 4,144,935 | 3/1979 | Bridges et al. | 166/248 |
| 4,148,614 | 4/1979 | Kirkbride | 204/158.2 |
| 4,175,885 | 11/1979 | Jeppson | 404/77 |
| 4,252,459 | 2/1981 | Jeppson | 404/77 |
| 4,252,487 | 2/1981 | Jeppson | 404/77 |
| 4,276,093 | 6/1981 | Pickerman | 106/281.1 |
| 4,347,016 | 8/1982 | Sindelar et al. | 404/95 |
| 4,376,033 | 3/1983 | Calderon | 208/402 |
| 4,376,034 | 3/1983 | Wall | 208/402 |
| 4,398,076 | 8/1983 | Hanson | 219/10.55 A |
| 4,449,585 | 5/1984 | Bridges et al. | 166/248 |
| 4,476,926 | 10/1984 | Bridges et al. | 166/248 |
| 4,485,868 | 12/1984 | Sresty et al. | 166/248 |
| 4,485,869 | 12/1984 | Sresty et al. | 166/248 |
| 4,498,535 | 2/1985 | Bridges | 166/248 |
| 4,524,827 | 6/1985 | Bridges et al. | 166/248 |
| 4,545,435 | 10/1985 | Bridges et al. | 166/248 |
| 4,619,550 | 10/1986 | Jeppson | 404/80 |
| 4,645,004 | 2/1987 | Bridges et al. | 166/248 |
| 4,670,634 | 6/1987 | Bridges et al. | 219/10.41 |
| 4,710,318 | 12/1987 | Horiuchi et al. | 252/628 |
| 4,746,968 | 5/1988 | Wear et al. | 219/10.55 F |
| 5,076,727 | 12/1991 | Johnson et al. | 405/128 |

OTHER PUBLICATIONS

Serota, R., "Heating with Radio Waves", Automation (Sep. 1973).

"Dielectric Heating: RF and Microwave", EPRI Center for Materials Fabrication, Tech Commentary, vol. 4, No. 1 (1987).

Lindroth, D., "Microwave Drying of Fine Coal", Technology News, Bureau of Mines, United States Department of the Interior, No. 282 (Aug. 1987).

"Dielectric Heating", product brochure, PSC, Inc., publication date unknown.

Bridges, J.E., et al. "RF/Microwave Volume–Reduction and Stabilization Systems for Radwaste Resins," Waste Management 1986 Symposium on Radioactive Waste Management.

*Primary Examiner*—Ngoclan Mai

*Attorney, Agent, or Firm*—Fitch, Even, Tabin & Flannery

[57] ABSTRACT

Ion exchange resins contaminated with a radioactive component are treated by exposing the contaminated ion exchange resins to a bound radio frequency electric field for uniformly heating them to drive off water. The dried ion exchange resins are then uniformly heated by a transversely uniform bound radio frequency electric field to a second higher temperature which chemically inactivates the functional groups of the ion exchange resins to destroy their hydrophilic property and convert them to a stabilized product for long-term safe storage.

3 Claims, 6 Drawing Sheets

METHOD FOR TREATING RADIOACTIVE WASTE

This application is continuation-in-part of application Ser. No. 08/454,0900 filed May 30, 1995 now abandoned, which is a continuation-in-part of application Ser. No. 08/096,361 filed Jul. 22, 1993 now abandoned, which is a continuation-in-part of application Ser. No. 07/952,205 filed Sept. 28, 1992 now abandoned, which is a continuation-in-part of application Ser. No. 07/502,288 filed Mar. 30, 1990, now abandoned.

BACKGROUND OF THE INVENTION

This invention relates to a method and apparatus for treating radioactive waste by heating. More particularly, the invention relates to a method and apparatus for using radio frequency energy to pyrolyze a batch of spent ion exchange resin contaminated with radioisotopes. The evaporation and pyrolysis inactivates the resin functional groups to destroy their hydrophilic property. It also reduces the resin volume so that relatively little space is needed for long term storage of the pyrolyzed residue or product.

As the use of nuclear reactors for the production of electrical power has become more common, it has become apparent that disposal of spent nuclear fuel has become a significant problem. What is perhaps not quite so well recognized is that other materials associated with the operation of nuclear power reactors become radioactive as from leaks from the primary cooling loop to the secondary cooling loop and that these materials must also be disposed of. Among such consumables are ion exchange resins in powder or bead form. They are used in condensate polishing operations to maintain the purity of cooling water.

In condensate polishing, water from the secondary cooling loop of a nuclear reactor is passed in contact with an anion exchange resin and a cation ion exchange resin to remove dissolved ionic species, such as chlorides, sulfides, sulfates, and various metals such as cadmium, mercury and strontium, which leak from the primary cooling to the secondary cooling loop of the nuclear reactor. These species might attack and damage the secondary cooling loop, leading to leaks of irradiated liquids. The anion exchange resin typically has functional groups comprised of sulfonates or carboxyls, while the cation exchange resin has amines as functional groups.

In the process of removing the unwanted species from the cooling water loop of the nuclear reactor, the ion exchange resins become mildly radioactive, possibly due to absorption of radioactive iodine or heavy metals. Their ion exchange capacity also gradually becomes depleted. When the resins have been used for a year or more, it usually is necessary to remove it from the power generating facility and replace them with fresh ion exchange resins. The spent radioactive resins then must be disposed of in a manner which does not contaminate the environment.

It is known that heating a resin drives off water and reduces its volume. There have been proposals to use various heat sources to dehydrate a spent resin, for instance by electrical resistance heaters and the like. These techniques lead to the production of considerable amounts of waste gases, as well as a non-uniform processing temperature of the resin. If such waste gases, which contain organic compounds and radioactive components, are vented into the atmosphere they may pose significant environmental and health hazards. Some of the conventional processes for treating the contaminated resin, such as by incineration, oxidize the resin, producing additional waste gases which must be disposed of properly. Alternative methods, such as the Rockwell air dry process, are expensive to practice when the resin is contaminated with radioactive components.

It has also been found that if the spent radioactive resin is pyrolyzed by conventional heat sources and stored in cement, in some cases the resin may rehydrate and swell, thereby, rupturing the cement containment and posing contamination problems. The rehydration problem is believed to be caused by the resin's having been treated at either too low or too high temperature or by non-uniform temperatures, which for portions of the resin are below and/or above the ideal resin partial pyrolysis temperature range of from 250° C. to 300° C. It is believed that the active groups of the ion exchange resin, the sulfonate, carboxyl and amine groups, are destroyed by temperatures exceeding 250° C. However, it has been found that when a temperature is substantially more than about 300° C., the resin releases hydrogen, which converts the resin to a graphitic material. The graphitic material bonds poorly to cement and cannot be securely stored by mixing it with cement and allowing the mixture to set. The lack of structural integrity in the cement-graphitic material prevents it from being safe enough for long-term radioactive material storage.

It has been proposed that it may be easier to heat the resin uniformly by exposing it to microwave power, rather than by using conventional heat sources; however, using microwaves to treat resin presents a number of other problems. If a mass of resin is heated by microwaves using conventional apparatus, heat loss from the resin mass at its surfaces due to conduction, convection or radiation results in temperature variations throughout the resin, which is highly undesirable. In Bridges, J. E. et al., "RF/Microwave Volume-Reduction and Stabilization System For Radwaste Resins," presented at the Waste Management 1986 Symposium on Radioactive Waste Management, it was disclosed that radio frequency energy and microwave energy produced by an RF power source and fed to an RF reactor, which could be sealed with radioactively contaminated ion exchange resin inside, may be used for the volume reduction and stabilization of those resins. In particular, it was there suggested that radioactive ion exchange resin beads can be treated by exposing them to microwave radiation, which drives off water left over from ion exchange processes. As there disclosed, the resin beads are then pyrolyzed. It is known that spent radioactive resin can be prevented from rehydrating by pyrolyzing it at a temperature of between 250° and 300° C. If the pyrolysis temperature is less than 250° C. the resin may rehydrate due to incomplete destruction of the functional groups which cause the resin to be hydrophilic. As may best be seen in FIG. 5 of Bridges et al., effluents from the RF reactor are fed to a vapor/liquid separator; gases from the vapor/liquid separator are received by a causticized carbon absorber; and liquids are pumped from the bottom of the separator to an activated carbon absorber.

Exposure of a batch of ion exchange resin to microwave energy in a cavity of the type which might be found in a microwave oven, however, is undesirable because the multiple modes in the cavity cause portions of the resin to heat at different rates. Other heating uniformity problems also may be encountered. In particular, this is because the electrical permittivity, also known as the dielectric constant, of the water-laden resin beads changes as they dry. Before the beads have been dried completely, they preferentially absorb microwave energy, causing the water to be volatilized from them. In some microwave ovens it has been found that heating can be made more uniform by the use of mode stirrers. However, mode stirrers, in and of themselves, are not sufficient to insure homogeneous heating of large batches of the ion exchange resin beads. Further, the depth of penetration of microwave energy, typically having a frequency above 900 MHz, into the resin volume is extremely small. For example, for nearly dried resins at temperatures between 100° C. and 150° C., irradiated with electromagnetic energy having a frequency of 1 GHz, the conductivity ranges between 0.1 and 1.0, the loss tangent from 0.5 to 0.16 and the related permittivity from 30 to 10. Under these conditions the power lost per centimeter of penetration is about 1 dB. In other words, for every 1 cm. advance of the microwave power into the resins, 20% of the impinging power is dissipated. This means that for about an inch of penetration, the heating at the surface of the resin volume is almost twice that at a one inch depth. Thus a large surface area must be exposed if microwave heating is to be used, and this results in both mechanical and heat transfer difficulties.

Other methods of heating are known for use in different environments. For instance, see Bridges et al., U.S. Reissue Pat. No. Re. 30,738 for Apparatus and Method for In Situ Heat Processing of Hydrocarbonaceous Formations, which discloses a method and an apparatus for heating buried materials, such as oil shale, bitumen, and the like. The apparatus employs a central exciter plate or equivalent electrode and a pair of grounded plates or equivalent electrodes outside it. The electrodes receive radio frequency energy and produce a transversely uniform radio frequency electric field for heating, by displacement current, the buried material bounded by the electrodes. In order to provide even more uniform heating of the buried deposits by such an apparatus, a method of and apparatus may be used for repetitively switching or altering the electrical termination of the electrodes of the apparatus to vary the longitudinal standing wave patterns of the electric field, as disclosed in U.S. Pat. No. 4,449,585 to Bridges et al. for Apparatus and Method for In Situ Controlled Heat Processing of Hydrocarbonaceous Formations. However, neither of the Bridges et al. patents provides a method of uniformly heating ion exchange resins contaminated with radioactivity in order to insure that the resins are completely pyrolyzed, while preventing them from becoming graphitic. Specifically, in the apparatus disclosed in U.S. Reissue Pat. Re. 30,738 and U.S. Pat. No. 4,449,585, some electric field non-uniformity exists near the extremities of the conductors. Such field non-uniformity cannot easily be tolerated for resin processing.

SUMMARY OF THE INVENTION

An apparatus and method for treating waste with bound radio frequency energy in the form of a bound radio frequency electric field, according to the present invention, enjoys a number of advantages over the prior apparatus and methods. One advantage of the instant apparatus is that it is able to heat uniformly a large batch of ion exchange resin contaminated with radioactive waste. Another advantage of the present invention is that it allows a batch of radioactive ion exchange resin to be pyrolyzed within a limited temperature range to prevent the resin from later rehydrating when stored. A further advantage of the instant invention is that it provides a batch type RF heating retort or reactor which provides easily controlled heating despite changes in electrical permittivity as the batch of ion exchange resin dries. A still further advantage of the instant invention is that it uniformly heats wet or dry batches of ion exchange resin without risking arcing and unwanted overheating or underheating of the resin, thus eliminating problems with electrical breakdown near the resin. Finally, the apparatus prevents the release of hazardous and/or radioactive substances to the environment.

The present invention provides improvements in methods of and apparatus for treating radioactively contaminated ion exchange resin and, in particular, provides an apparatus for treating a large batch of radioactively contaminated ion exchange resin to provide substantially transversely uniform or isothermal heating to the resin. The substantially uniform heating insures that the entire resin is pyrolyzed within a relatively narrow range of temperatures, from 250° C. to 300° C., so that it does not later rehydrate to cause it to breach the cement in which it is potted. In order to achieve uniform heating of the ion exchange resin contaminated with radioactive waste, an enclosed reactor incorporates three parallel longitudinally extending electrodes. The three parallel electrodes comprise a pair of outer plate electrodes, which are grounded either to the reactor container or to an appropriate ground, and a centrally positioned inner exciter electrode. The electrodes are connected to a transition section, which is connected via a coaxial cable to a conventional source of radio frequency energy, such as a linear amplifier driven by an oscillator.

Uniform heating of the ion exchange resins is provided by having the resins loaded into a treatment volume of the reactor in contact with the exciter plate and the grounded plates. Radio frequency energy is then supplied to the exciter electrode and the grounded electrodes causing a pair of substantially transversely uniform time-varying or alternating electric fields to be created between the first grounded electrode and the inner exciter plate and the second grounded electrode and the inner exciter plate, respectively. If certain design criteria are used electric fields are transversely uniform, but not necessarily longitudinally uniform, due to power absorption by the resin along the length of the electrodes. As the ion exchange resin is heated by both conductive and displacement currents, with the displacement currents tending to predominate as the ion exchange resin is dried, the electrical energy from the time-varying electric field is preferentially absorbed by any remaining wet portions of the resin, also leading to differences in power distribution along the electrodes, but at the same time to a more uniform temperature. The reactor, however, is relatively short. The length of the treatment volume extends less than two skin depths of field penetration at the electrical permittivity of wet resin, preferably much less than two skin depths of distance. Because the amount of power fed to the electrodes is controlled by the linear amplifier and because the electric field which causes the heating is transversely uniform, the radioactive ion exchange resin beads or powder packed between the electrodes is heated substantially transversely uniformly.

In order to heat the resin even more uniformly, a plurality of electrical resistance guard heaters surround the treatment volume of the reactor so that a large temperature gradient is not present at the periphery of the treatment volume. Without the guard heaters, the loss of heat to the outermost portions of the reactor results in preferential cooling of the ion exchange resin beads or powder located at the periphery of the treatment volume. Such cooling could keep the temperature of a portion of the resin below 250° C. and preventing it from being properly pyrolyzed. Alternatively, some portion of the resin might be overheated over 300° C. leading to the conversion of the resin to a graphitic material which is unsuitable for storage in cement. As the resin dries its electrical permittivity decreases causing the heating mode to change from a substantially conduction current mode to a substantially displacement current mode.

In addition, the instant invention is designed with the RF heating reactor having its inner exciter and ground electrodes fed by a transition section connected to a coaxial cable. The transition section, at the energy entrance portion of the reactor, is filled with a low-loss dielectric comprising an electrical insulator. In a like fashion, a substantially identical tapered transition section may be used at the other end of the reactor connected to the three electrodes on one side and to a coaxial cable on the other side that feeds a mode-mixing unit having a switch which may be opened and closed to vary the electrical termination characteristics of the far end of the triplate line. The two tapering transition sections are filled with electrical insulation because without the electrical insulation, as the electric field increases and the ground plate extensions approach the exciter plate extension, arcing would occur. This is because the electric field strength is made as high as safely possible within the parallel section of the plates in order to insure rapid and efficient resin heating. Further, in order to reduce the likelihood that longitudinal standing waves would result in non-uniform temperatures due to resin at the nodes of the electric field standing waves receiving relatively little energy other than by thermal conduction, the electrically alterable termination is switched from one electrical state to another to alter the longitudinal standing wave patterns within the treatment volume from time to time. Such changes in the longitudinal standing waves allow the resin positioned between the inner exciter plate and the grounded plates to be heated relatively uniformly longitudinally.

It is a principal aspect of the present invention to provide an apparatus and method for partially pyrolyzing ion exchange resin within a narrow range of pyrolyzing temperatures to prevent it from later rehydrating.

It is another aspect of the present invention to provide an apparatus and method for heating radioactively contaminated ion exchange resin, without venting contaminated gases to the environment.

It is another aspect of the present invention to provide an apparatus for uniformly heating ion exchange resin by means of a transversely uniform alternating electric field which provides uniform heating to the resin positioned within a reactor.

These and other aspects and advantages of the present invention will become apparent from the following detailed description, particularly when taken in conjunction with the accompanying drawings.

DETAILED DESCRIPTION OF THE PREFERRED EMBODIMENT

Figure 1:
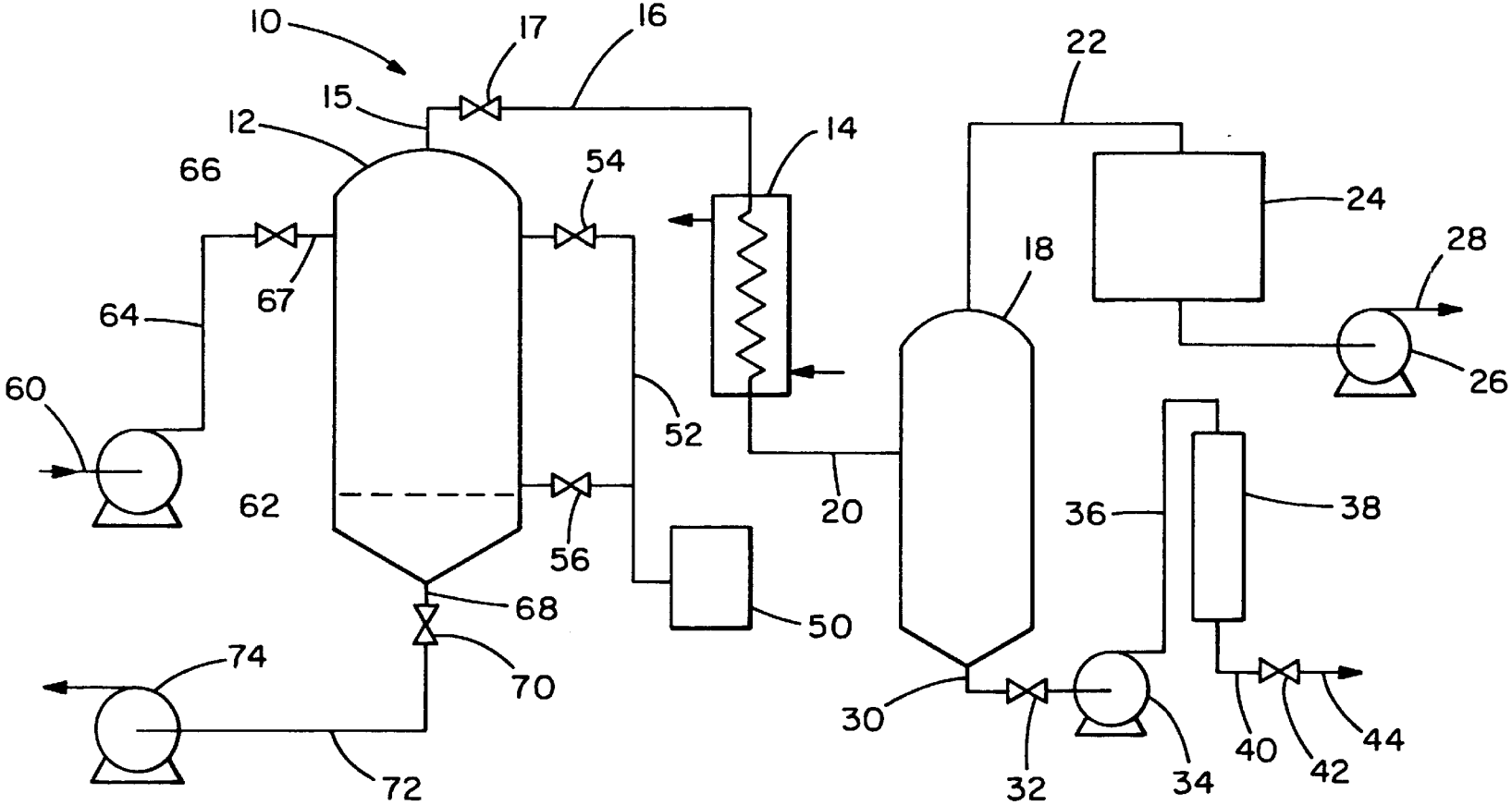
FIG. 1 is a diagrammatic illustration of a system for uniformly heating a batch of radioactive ion exchange resin in accordance with one embodiment of the present invention.
Figure 3:
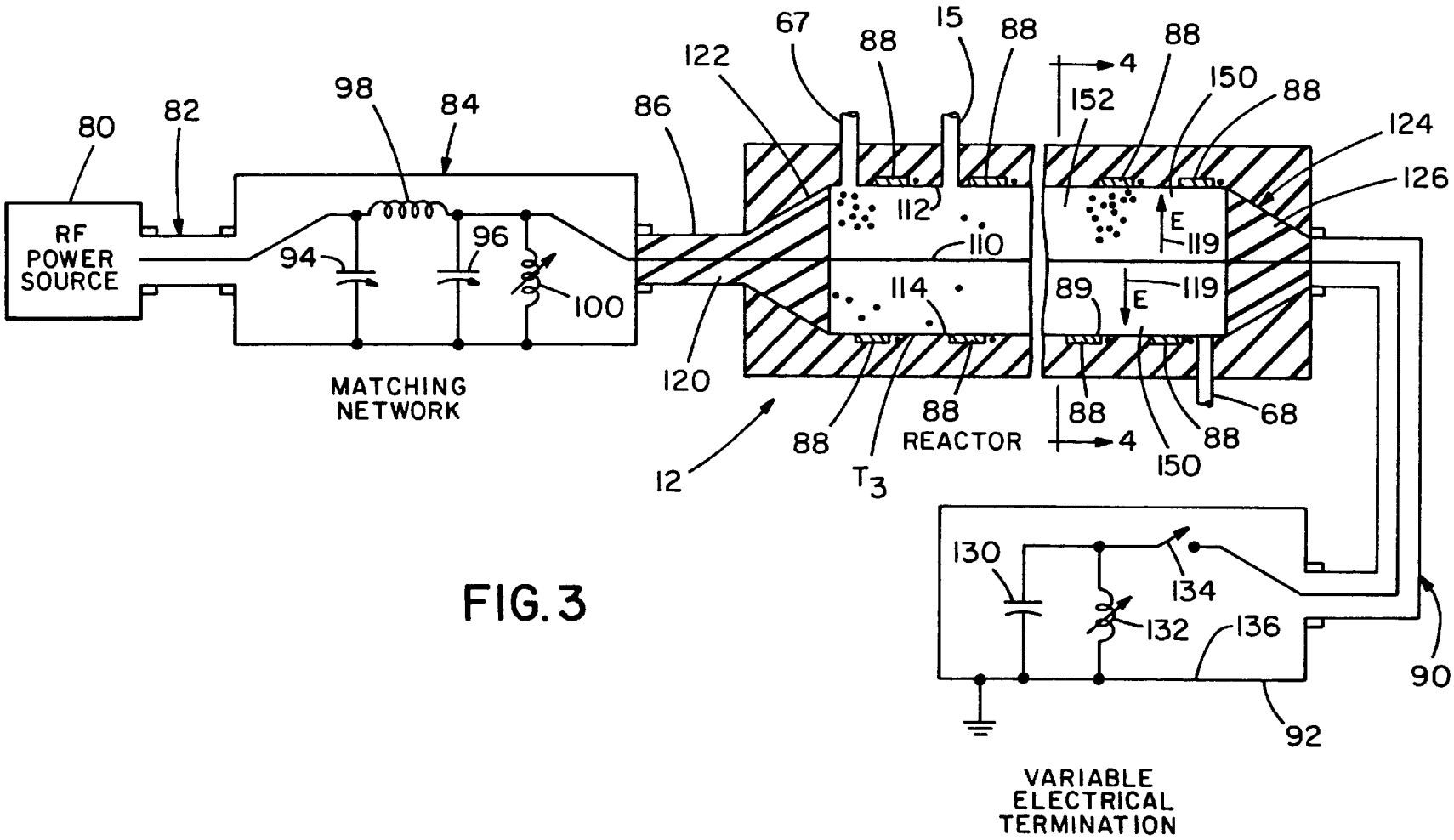
FIG. 3 is a partly diagrammatic, partly sectional view of a reactor and associated circuitry for treating a batch of ion exchange resin in the system shown in FIG. 1.

FIG. 1 shows a system 10 according to the present invention for uniformly heating a batch of waste by means of bound radio frequency energy, specifically uniformly heating ion exchange resin contaminated with radioactivity. The system 10 includes a radio frequency reactor, retort or container 12, having an exterior insulated wall 13, as shown in FIG. 3, for receiving and treating a batch of ion exchange resin contaminated with radioactive material. The batch of ion exchange resin may be in the form of beads or powder. In either case, the ion exchange resin is in a particulate form. A heat exchanger 14 is connected to the reactor 12 via a series of lines 15 and 16 and a valve 17 to receive gaseous effluent and remove heat therefrom. A demister 18 is connected to the heat exchanger 14 via a line 20 to receive the cooled fluids and remove liquids from them. A line 22 is connected to receive gases from the demister 18 and feed them to a charcoal gas filter 24 where the radioactive materials are absorbed. In particular, radioactive heavy metals and organic compounds evolved from pyrolyzing the batch of contaminated ion exchange resin are absorbed by the activated carbon within the charcoal filter 24. A pump 26 connected to the gas filter 24 ultimately exhausts harmless remaining gases via a line 28 to a stack.

Contaminated liquids are drawn off from the demister 18 via a line 30 through a check valve 32 by a pump 34. The pump 34 forces the liquid into a line 36 connected to a charcoal filter assembly 38. Contaminants are removed by the charcoal filter assembly 38 and purified water is output via a line 40 through a check valve 42 to an appropriate output stream line 44. In order to insure that while the batch of ion exchange resin is being heated within the RF reactor 12 it does not oxidize, nitrogen from a nitrogen tank 50 is fed via a line 52 through a pair of check valves 54 and 56 to the RF reactor 12. Spent and/or contaminated wet ion exchange resin is supplied to the reactor 12 by means for filling the container with a batch of ion exchange resin. The filling means comprises a line 60, a two gallon per minute Moyno pump 62 connected to the line 60, a line 64 and a valve 66. The pump 62 forces the batch of wet ion exchange resin through the line 64, and the valve 66 and a line 67 into the reactor 12. A batch of stabilized or treated product, which is pyrolyzed ion exchange resin having its hydrophilic property destroyed so that it does not rehydrate in storage, may be drawn off by means for removing the batch of stabilized product from the container. The removing means comprises a line 68, a check valve 70, a line 72 and a pump 74. The stabilized product is removed from the reactor 12 through the line 68, the check valve 70, the line 72 and the pump 74.

Figure 2:
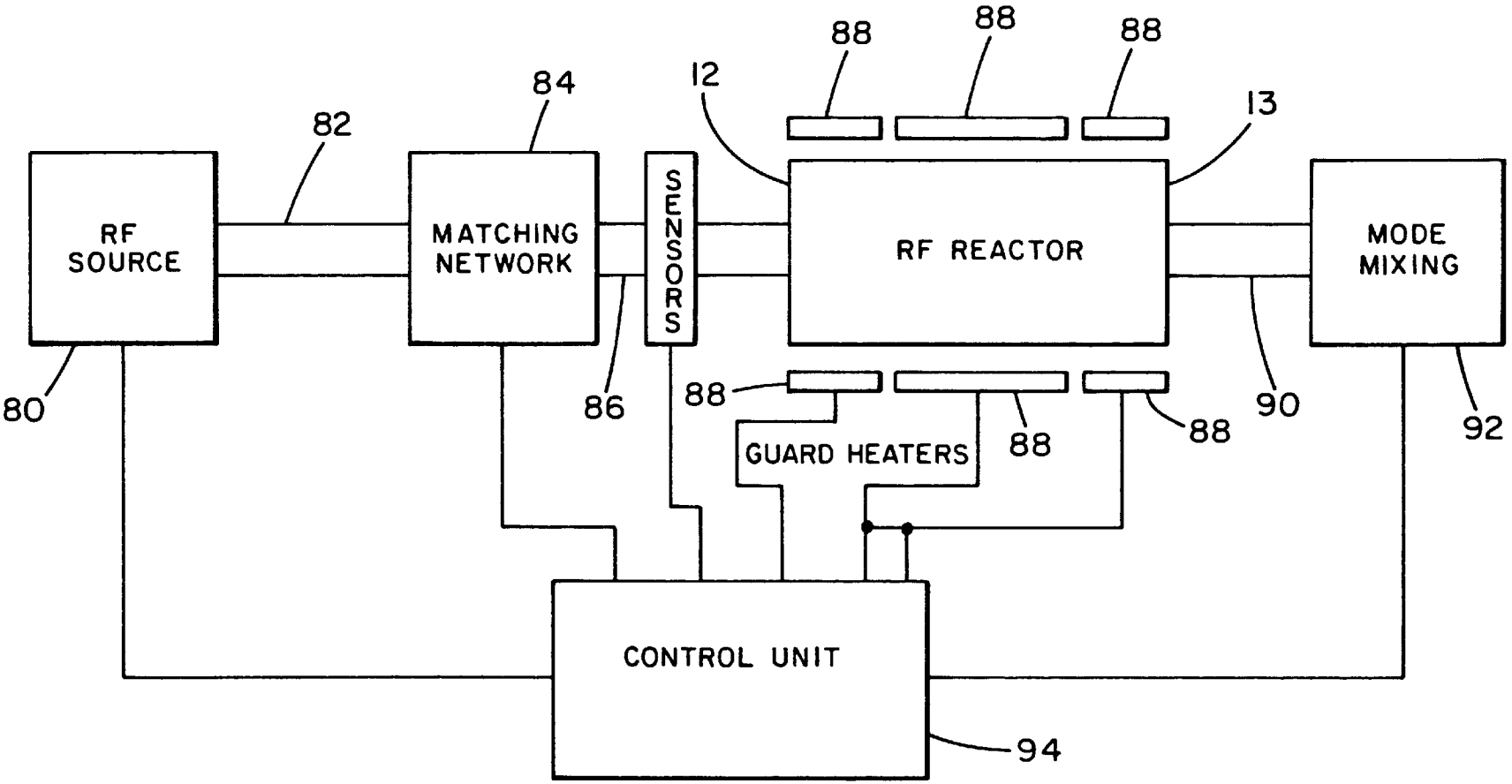
FIG. 2 is a diagrammatic illustration of a portion of the system shown in FIG. 1, showing details of the electrical connections of portions of the system with a reactor for treating a batch of radioactive ion exchange resin.
Figure 4:
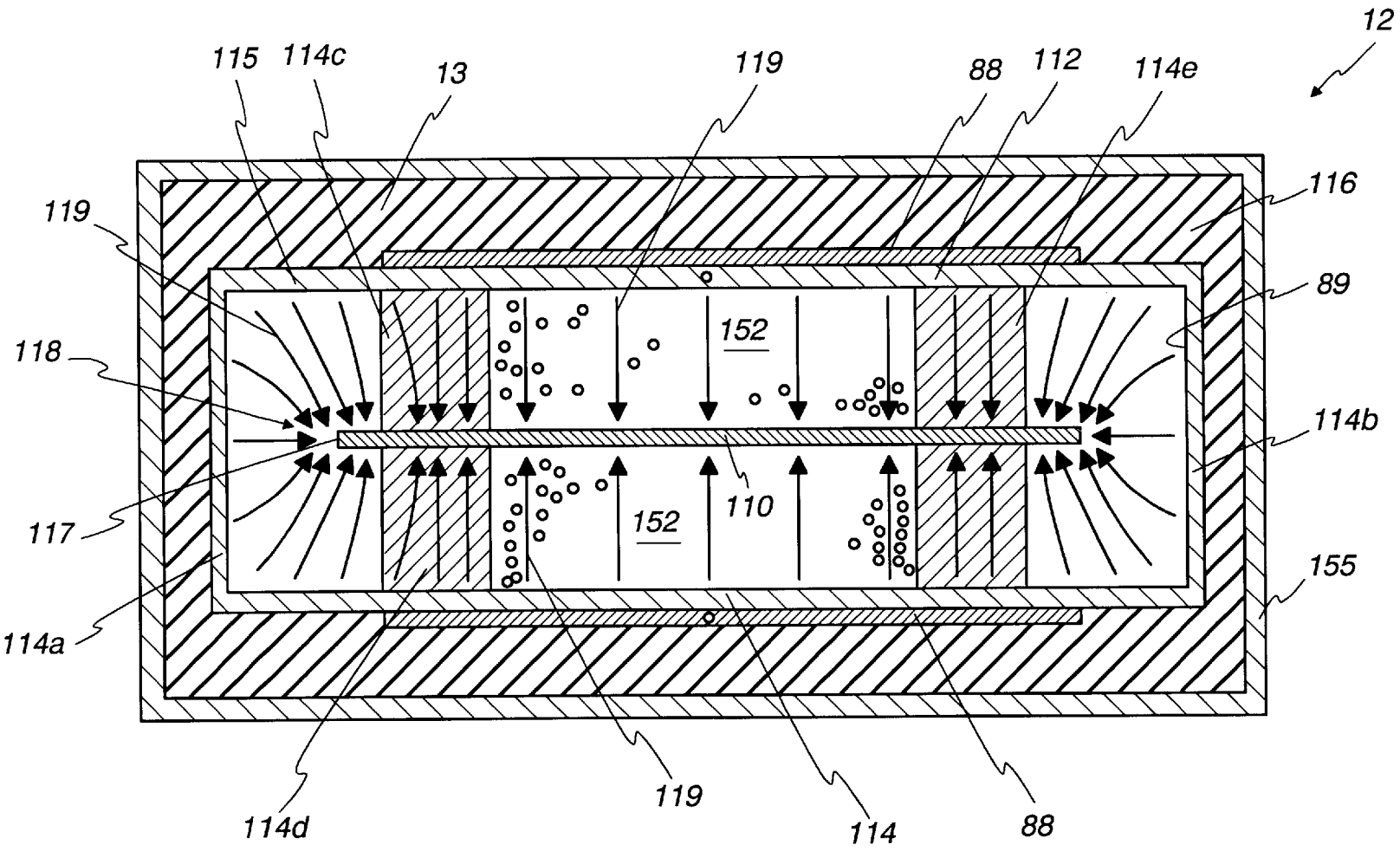
FIG. 4 is a sectional view of the reactor shown in FIG. 3 and taken along line 4—4 of FIG. 3 showing details of the interior of the reactor as well as the radio frequency electric field.

FIGS. 2, 3 and 4 show the reactor 12 in greater detail, as well as associated electric circuitry for supplying radio frequency potential and current to the reactor 12. A radio frequency power source 80, including a variable frequency oscillator and a linear amplifier, feeds a coaxial cable 82 with high frequency power. A matching network 84 provides impedance matching for coupling power to the reactor 12 through a coaxial cable 86. The reactor 12 has a plurality of electrical resistance guard heaters 88 and thermocouples 88*a* surrounding a peripheral region 89 for reducing the temperature differential between the interior of the reactor 12 and the ambient, so that more uniform heating of the contents of the reactor 12 can be achieved. In this embodiment the guard heaters preferably are Chromalox type SE chrome steel sheath resistance heaters, Chromalox product code number 130753. A coaxial cable 90 connects the reactor 12 to a mode-mixing network 92. A control unit 94 receives signals from the thermocouples 88a and supplies control signals to the RF source 80, the matching network 84, the electric resistance guard heaters 88 and the mode-mixing network 92 to control heating of the reactor 12.

In particular, referring to FIGS. 3 and 4, the RF power source 80 includes a conventional variable frequency oscillator connected to a ten kilowatt power source which feeds radio frequency energy, which may be in a range of frequency from 100 kilohertz to 300 megahertz, through the coaxial cable 82 to the matching network 84. The matching network 84 includes a pair of variable capacitors 94 and 96 having a fixed inductor 98 connected to them in a pi configuration. A variable inductor 100 is connected across the variable capacitor 96. The capacitors 94 and 96, as well as the inductor 100, may have their impedances varied in order to provide an impedance match from the RF power source 80 to the reactor 12. Such impedance matching networks are well known in the art. The radio frequency energy is then fed from the impedance matching network 84 via the coaxial cable 86 to the reactor 12.

The reactor 12 includes a center exciter electrode plate 110, a first grounded outer electrode plate 112 and a second grounded outer electrode plate 114, these comprise a triplate electrode arrangement. The first grounded outer electrode plate 112 and the second grounded outer electrode plate 114 may be connected together at their edges by a pair of conductive side plates 114*a* and 114*b* to form a totally shielded and grounded box 115. The electrodes are separated by low-loss high temperature insulators 114*c*, 114*d*, 114*e* and 114*f*. Thermal insulation 116 and the guard heater 88 are positioned outside the box 115. An additional metallic shield 155 may be positioned around the guard heater 88 and the thermal insulation 116. Together the thermal insulation 116 and the metallic shield 155 comprise the exterior wall 13. A low-loss dielectric 120 fills a transition section 122 connected to the electrodes 110, 112, and 114. The low-loss dielectric 120 prevents the relatively high electric field strengths in the transition section 122 from causing unwanted arcing or breakdown in the portion of the reactor 12 where the conductors are relatively close together. The plates 110, 112 and 114 are also connected to a second transition section 124 substantially identical with the transition section 122 and also filled with an identical low-loss dielectric 126 to prevent arcing and breakdown. The coaxial cable 90 is connected to the transition section 124 and to the mode-mixing network 92.

The mode-mixing network 92 includes a variable capacitor 130 and a variable inductor 132 connected in parallel between a switch 134 connected to the center electrode 110 and a grounded lead 136 connected to the grounded plates 112 and 114. The switch 134 is opened and closed periodically or from time to time by the control unit 94 to alter the pattern of longitudinal standing waves within the reactor 12 in order to provide more uniform heating longitudinally within the reactor. The transverse direction is any direction normal to the longitudinal direction.

The grounded outer electrodes 112 and 114 are separated by a distance equal to twice the distance between the electrodes 110 and 114, which is no greater than one-half the wavelength of the radio frequency energy. This constraint prevents the formation of unwanted standing waves within the reactor 12 and thus leads to more uniform heating of material therein. The electrode plates 110, 112 and 114 extend longitudinally through the reactor 12 a distance which is less than one skin depth of the wet ion exchange resin when exposed to the radio frequency electric field 119 produced between the electrodes 110, 112 and 114.

The reactor 12 is utilized to treat batches of waste, such as radioactive or otherwise contaminated ion exchange resin beads 150. While beads 150 are disclosed herein, the powder form of ion exchange resin may also be treated by the apparatus and method of the present invention. The beads 150, typically contaminated with radioactive heavy metals, are introduced through the pipe 67 and contained within a treatment volume 152 by the wall 13 of the reactor, the volume being partly defined by the grounded electrodes 112 and 114 and the low-loss high temperature insulators 114*c*, 114*d*, 114*e* and 114*f*. The treatment volume 152 is limited by the insulators 114*c*–114*f* to the region in which the electric field 119 is transversely uniform so that transversely uniform heating of the beads 150 occurs therein.

The regions 118 near the transverse ends 117 of the exciter electrode 110 experience highly non-uniform electric fields. In order to avoid non-uniform heating of the beads, the processing volume is confined to the uniform field region between the exciter electrode 110 and the ground electrodes 112 and 114. Such a uniform heating transverse section is achieved by spacing the treatment region 152 from the ends 117 by a distance at least one-half as great as the distance between the electrode plates 110 and 114. That is the distance between the inside faces of the insulators 114*d* and 114*f* and the respective ends 117 is equal to or greater than one-half the distance between the plates 110 and 114. The distance between the insulators 114*d* and 114*f* preferably is made equal to or greater than the distance between the plates 110 and 114.

Once the batch of wet ion exchange resin beads 150 is positioned within the treatment volume 152 it may have water drained therefrom through the pipe 68. Radio frequency power then is supplied from the power source 80 through the matching network 84 to the electrodes 110, 112 and 114 where the batch of resin beads 150 is heated to evolve gases from the resin beads 150 in order to produce a batch of dried ion exchange resin. In particular, steam and other gases are vented from the connection 15 to the heat exchanger 14, which removes a portion of the heat from the gases. The cooled gases, which include water droplets and other condensate, are fed to the demister 18 which traps the liquid fractions. Most of the water vapor is condensed within demister 18 and pumped as water through the charcoal filter 38 which removes contaminates therefrom. Volatile gases, such as organic compounds and any volatilized radioactive iodine, exit the demister 18 at the pipe 22 and are absorbed in the charcoal filter 24 before the remaining harmless waste gases, primarily nitrogen, are released through the stack connection 28. The electric resistance heaters 88 help to maintain an isothermal environment within the treatment volume 152 by heating the peripheral region 89 to prevent the evolved gases and vapors from condensing on the wall 13 and the beads 150.

As the batch of ion exchange resin beads 150 is heated along with mode mixing, the highest power supplied to the beads 150 is near the transition section 122 and the lowest power is near the transition section 124 because of power absorbed along the reactor 12; however, preferably the distance between the transition sections 122 and 124 is kept to less than one skin depth of the wet ion exchange resin beads 150 in order to insure that the decrease in power from the transition section 122 to the transition section 124 is less than 50%, because one skin depth is the distance in a medium at which the internal electric field strength is 1/e or about $1/2.718$ of the electric field strength of the applied electric field. Preferably the reduction in field strength is substantially less than 50% in order to insure that the beads 150 are heated relatively uniformly. Alternatively, it is possible progressively to dry the resins along the axis from 122 to 124 so as to realize the 1/e criterion only after the resins have reached a temperature of 150° C. The is possible because the absorptivity or conductivity of the resins decreases radically as shown in FIG. $_{13}$ as the temperature rises from 110° C. to 150° C. This prevents substantial heating near the transition section 122 once temperatures near 140° C. to 150° C. are realized In an alternate embodiment, the reactor 12 may be driven from both ends. The distance between the two ends of such a reactor may be a total of two skin depths of wet resin although the difference in power levels between the maximum power points and the point at which minimum occurs is such that the power difference between the points is less than 50%. In particular, it may be appreciated that because the electric field 119 is oriented substantially transversely with respect to the plates 110, 112 and 114, the beads 150 are substantially transversely uniformly heated. This allows the beads to be heated uniformly once the water is volatilized therefrom and the batch of dried ion exchange resin is left. This allows the batch of dried ion exchange resin beads 150 to be pyrolyzed into a batch of stabilized product which will not rehydrate. Similarly, the absorption criterion for dual excitation need not be applied until the resins have dried and reach 150° C.

In the case of resins commonly used, the pyrolysis temperature is preferably between 250° C. and 300° C. The preferred temperature range assures that the functional groups of the resins are destroyed, thereby destroying the hydrophilic property of the resin. If the stabilized product were graphitic it would not bind well with cement and would thus unsuitable for long term storage potted in cement. Further, transverse resin batch temperature uniformity is enhanced by the electric resistance guard heaters 88, which reduce the thermal gradient from the treatment volume 152 of the reactor 12 to the ambience in order to permit all portions of the batch of beads 150 in the treatment volume 152 to reach the desired minimum temperature before any exceeds 300° C., which would cause them to become graphitic. Once all the beads 150 have been completely pyrolyzed to the desired state forming stabilized product particles, the batch of stabilized product particles may be released from the outlet pipe 68.

The batch of stabilized product may then be mixed with a potting material such as cement and the resulting cement and stabilized product mixture allowed to set for storage. The cement provides a high integrity container. Because the stabilized product is not graphitic, it will bind well with the cement to provide a high integrity storage body for long term storage. Because the stabilized product is not hydrophilic it will not absorb the water from the hardened cement. Such unwanted absorption would lead to a loss of structural integrity in the storage body and the possible release of radioactive substances into the environment. Under some circumstances other potting materials may be used to fix and store the stabilized material such as asphalt or vinylester-styrene may be chosen.

The instant invention provides a method and apparatus for treating ion exchange resins contaminated with radioactive waste by heating the ion exchange resins uniformly in the transversely isotropic electric field 119 which allows the resins to be dehydrated and to be subsequently pyrolyzed at a narrow range of temperatures, specifically 250° C. to 300° C. for the particular resins commonly used, thereby converting the batch of hydrophilic ion exchange resin beads to a batch of stable product which does not readily rehydrate. The reactor 12 has been specifically designed so that the electric field 119 within the treatment volume 152 is at a maximum without leading to unwanted arcing or breakdown which might cause inadvertent pyrolysis above 300° C. to take place. The system is totally enclosed, all of the effluents being fed through carbon bed filters, which prevent contamination of the environment.

In the specific embodiment described herein the volume 152 within the reactor 12 is selected to be from 0.2 to 0.8 cubic meters to allow convenient treatment of batch quantities of ion exchange resins of the type available from power plants. The reactor 12 has its dimensions optimized in order to pyrolyze the batch of ion exchange resin beads efficiently. The electric field strength was chosen to be one-tenth of the field strength which would lead to electrical breakdown. The depth of penetration of the time-varying electric field 119 is important in part because it changes as the ion exchange resin dries. In the region of frequencies of 10 MHz to 100 MHz the skin depths range from one to ten meters. At a frequency of 2.45 GHz the ion exchange resin skin depth is about five centimeters. At a frequency of 915 MHz the skin depth is about ten centimeters. Thus a batch type reactor is out of the question at 2.45 GHz due to the large reactor width and height needed to accommodate 0.2 to 0.8 cubic meters of ion exchange resin beads spread in a layer less than five centimeters thick, in order to obtain uniform heating of the beads. The lowest acceptable frequency thus should be used to obtain optimal electric field penetration into the wet ion exchange resin beads.

Often the resin drying takes place in three stages. The first stage involves vaporizing most of the water and should take about six hours. This requires fifteen kilowatts of power. The second stage, carried out at a temperature of 110° C. to 200° C., should take about five hours. It requires an average power of one kilowatt. In the third stage it takes about eight hours to heat the resin from 200° C. to 300° C. The applied electric field strength was limited to 1400 volts per meter, which is roughly one order of magnitude below the electric field strength at which breakdown effects occur. Breakdown should be avoided as it leads to localized non-uniform heating of the resin. Since the resin heating rates vary with the frequency of the applied electric field 119 as well as the electric field strength, a minimum selected electric field frequency, in this instance 40 MHz, to produce heating at the aforementioned rates for a given electric field strength is required.

Figure 5:
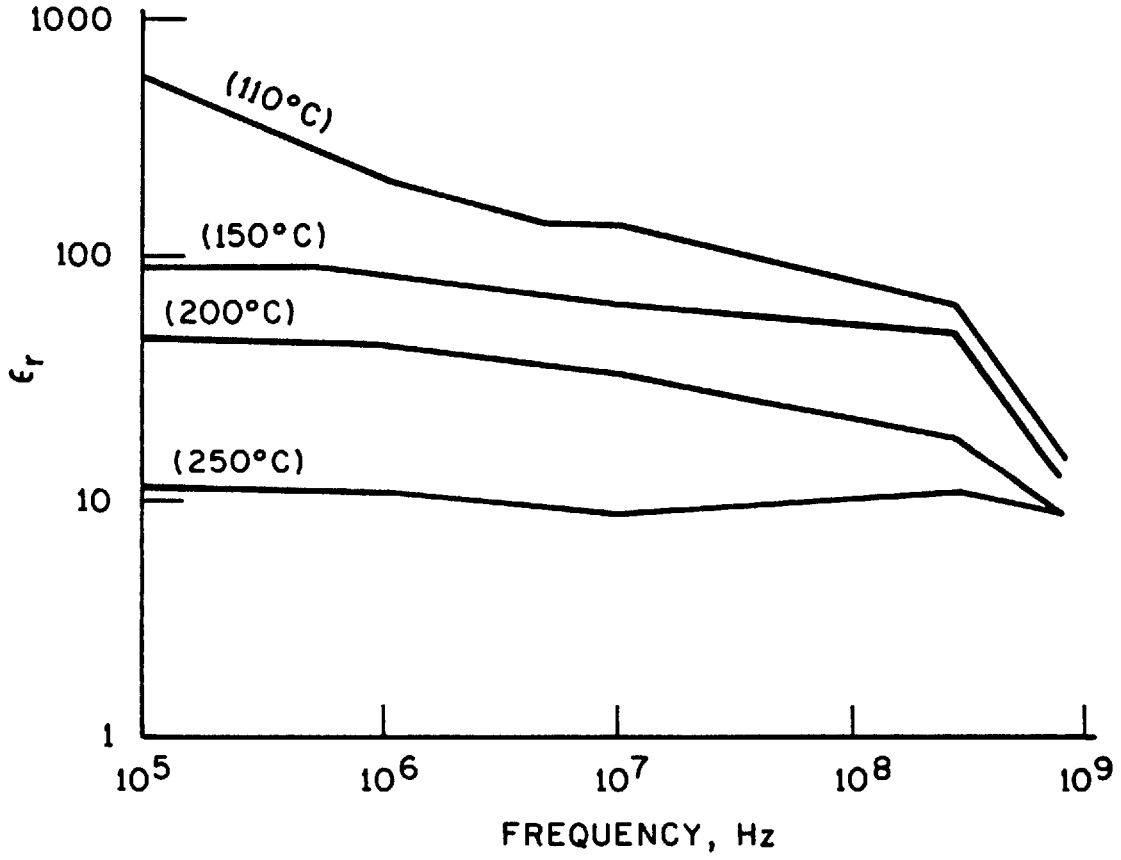
FIG. 5 is a graph for selected temperatures of the frequency of an applied radio frequency electric field versus the relative dielectric constant of spent ion exchange resin beads from the secondary cooling loop of a nuclear reactor.
Figure 6:
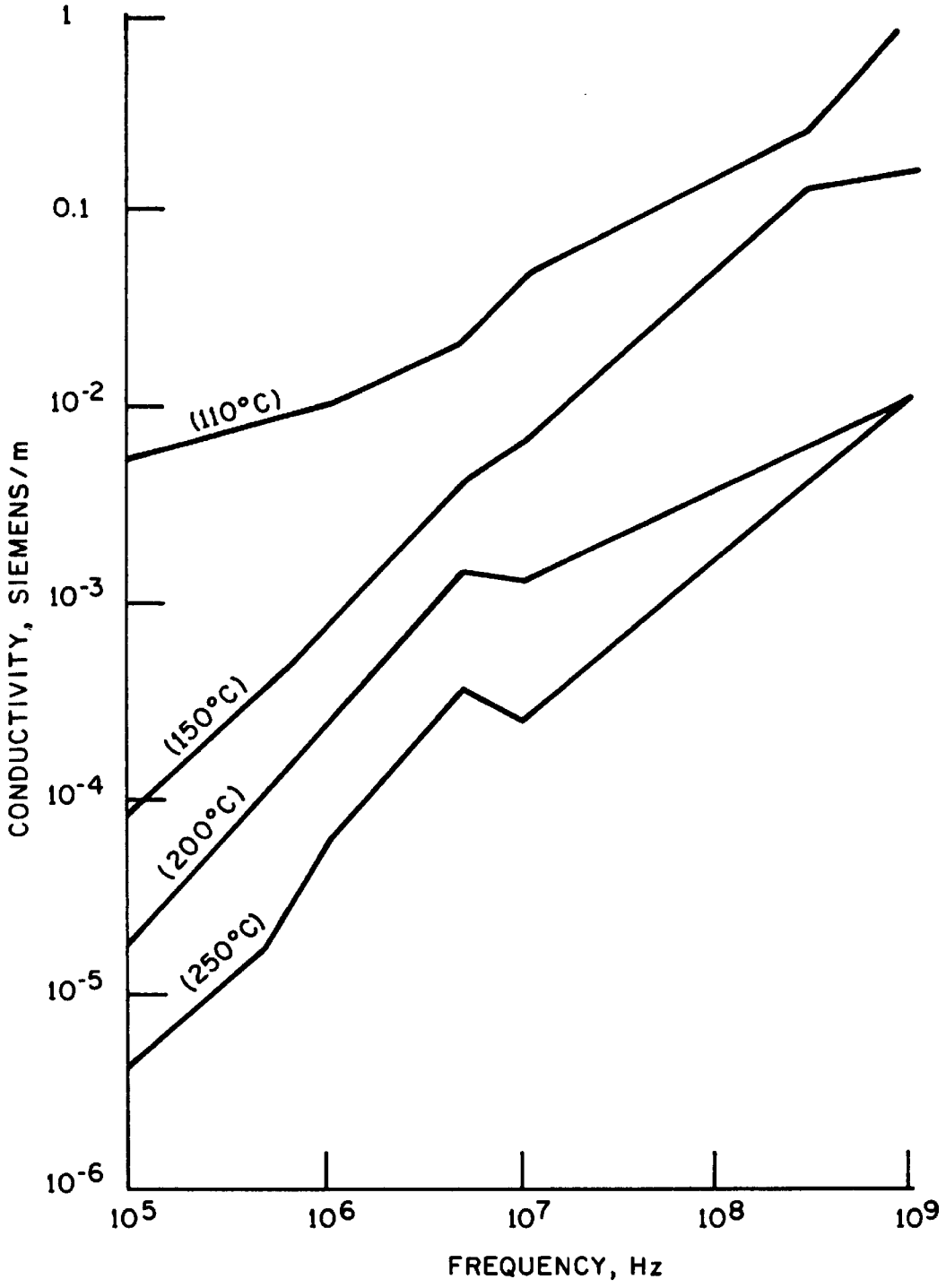
FIG. 6 is a graph for selected temperatures of the frequency of an applied radio frequency electric field versus the conductivity of spent ion exchange resin beads from the secondary cooling loop of a nuclear reactor.

The relative dielectric constant and the conductivity of the resin change as the frequency of the applied field changes, as is shown in FIGS. 5 and 6. The reactor 12, being fed with radio frequency energy from only one end, also may be sized so that the longitudinal dimension of the electrodes is considerably less than one skin depth, at 40 MHz, of wet ion exchange resin in order to provide relatively uniform longitudinal heating characteristics within the reactor 12. In addition the reactor must not have standing waves, other than in the longitudinal direction, in order to insure transversely isothermal heating of the resin. This constraint avoids having an end product which cannot be stored safely because it remains partly hydrophilic and/or because it is partly graphitic due to processing temperatures outside the preferred range during pyrolysis. The outer ground plates should be separated by a distance less than one-half the wavelength of the field at 40 MHz in order to avoid propagating energy in any mode other than the fundamental mode.

While there have been illustrated and described particular embodiments in the present invention, it will be appreciated that numerous changes and modifications will occur to those skilled in the art which fall within the true spirit and scope of the present invention.

What is claimed is:

1. A method for treating a batch of hydrophilic ion exchange resin contaminated with a radioactive component, comprising the steps of:

drying the batch of ion exchange resin by heating the batch of ion exchange resin with a substantially transversely uniform time-varying electric field to produce a batch of dried ion exchange resins; pyrolyzing the batch of dried ion exchange resin to a batch of stabilized product by heating the batch of dried ion exchange resin to a temperature which is less than the temperature at which the stabilized product becomes graphitic with a transversely uniform time-varying electric field to a temperature high enough to destroy the hydrophilic property of the batch of ion exchange resin, the batch of stabilized product occupying less volume than the batch of ion exchange resin; and heating a peripheral region bounding the batch of ion exchange resin to reduce heat loss from the batch of ion exchange resin being treated resulting in a temperature gradient across the batch of ion exchange resin in order to prevent unwanted condensation of gasses evolved by heating the batch of ion exchange resin and in order to prevent portions of the batch of ion exchange resin from being overheated which would cause the ion exchange resin to be converted to a graphitic product.

2. A method according to claim 1 further comprising condensing materials evolved during said drying and pyrolyzing steps and adsorbing components therefrom.

3. A method according to claim 1 further comprising adsorbing materials evolved during said drying and pyrolyzing steps.

* * * * *